US006471339B1

(12) United States Patent
Kamiyama et al.

(10) Patent No.: US 6,471,339 B1
(45) Date of Patent: Oct. 29, 2002

(54) SUBSTRATE FOR THERMAL RECORDING HEAD, INK JET RECORDING HEAD USING THE SUBSTRATE, RECORDING APPARATUS WITH THE RECORDING HEAD, AND METHOD OF DRIVING RECORDING HEAD

(75) Inventors: Yuji Kamiyama, Fujisawa; Fumio Murooka, Atsugi; Tatsuo Furukawa, Atsugi; Shuichi Katao, Atsugi; Yoshiyuki Imanaka, Yokohama; Hiroyuki Maru, Atsugi; Masaaki Izumida, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/656,016

(22) Filed: Sep. 7, 2000

Related U.S. Application Data

(62) Division of application No. 09/350,296, filed on Jul. 9, 1999, which is a division of application No. 08/300,122, filed on Sep. 2, 1994, now Pat. No. 5,943,070.

(30) Foreign Application Priority Data

Sep. 8, 1993 (JP) ..... 5-223495

(51) Int. Cl.[7] ..... B41J 2/045
(52) U.S. Cl. ..... 347/61
(58) Field of Search ..... 347/61, 19, 17, 347/67, 57, 58, 59, 14, 56, 54, 20, 1

(56) References Cited

U.S. PATENT DOCUMENTS

| | | |
|---|---|---|
| 4,313,124 | 1/1982 | Hara |
| 4,345,262 | 8/1982 | Shirato et al. |
| 4,429,321 | 1/1984 | Matsumoto |
| 4,459,600 | 7/1984 | Sato et al. |
| 4,463,359 | 7/1984 | Ayata et al. |
| 4,558,333 | 12/1985 | Sugitani et al. |
| 4,608,577 | 8/1986 | Hori |
| 4,723,129 | 2/1988 | Endo et al. |
| 4,740,796 | 4/1988 | Endo et al. |
| 4,910,528 | 3/1990 | Firl et al. |
| 5,175,565 | 12/1992 | Ishinaga et al. |
| 5,212,503 | 5/1993 | Saito et al. |
| 5,319,389 | 6/1994 | Ikeda et al. |
| 5,943,070 | * 8/1999 | Kamiyama et al. |
| 6,022,093 | 2/2000 | Arai et al. |

FOREIGN PATENT DOCUMENTS

| | | |
|---|---|---|
| EP | 0511602 | 11/1992 |
| EP | 0593041 | 4/1994 |
| EP | 0626263 | 11/1994 |
| JP | 54-56847 | 5/1979 |

(List continued on next page.)

*Primary Examiner*—Raquel Yvette Gordon
(74) *Attorney, Agent, or Firm*—Fitzpatrick, Cella, Harper & Scinto

(57) ABSTRACT

This invention has as its object to provide a substrate for an ink jet recording head, which is compact and can realize stable recording with high reliability, a recording head using the substrate, a recording apparatus mounting the recording head, and a method of driving the recording head.

There are disclosed a substrate for a thermal recording head, having a plurality of heating resistor elements, a plurality of wiring electrodes for supplying driving signals to the heating resistor elements, a function element, electrically connected to the heating resistor elements, for selectively driving the plurality of heating resistor elements, and a measurement resistor element which is electrically independent form the heating resistor elements and the function element, and haws a resistance value larger than that of each heating resistor element, an ink jet head, a head cartridge, and a recording apparatus utilizing the substrate, and a method of driving a recording head using a measurement resistor.

40 Claims, 7 Drawing Sheets

FOREIGN PATENT DOCUMENTS

| | | |
|---|---|---|
| JP | 58-89386 | 5/1983 |
| JP | 59-123670 | 7/1984 |
| JP | 59-138461 | 8/1984 |
| JP | 60-71260 | 4/1985 |
| JP | 62-77949 | 4/1987 |
| JP | 63-312861 | 12/1988 |
| JP | 1-122451 | 5/1989 |
| JP | 3208654 | 9/1991 |
| JP | 5-169661 | 7/1993 |
| WO | 88-02310 | 4/1988 |

* cited by examiner

SIMULTANEOUS FORMING OF 2nd ELECTRODES Aℓ AND TaN

DRYETCHING OF 2nd ELECTRODES Aℓ, TaN

WET ETCHING OF 2nd ELECTRODE Aℓ

SIMULTANEOUS FORMATION OF Ta AND SiN FILMS

PATTERNING Ta AND FORMING THROUGH HOLE AT SiN

SUBSTRATE FOR THERMAL RECORDING HEAD, INK JET RECORDING HEAD USING THE SUBSTRATE, RECORDING APPARATUS WITH THE RECORDING HEAD, AND METHOD OF DRIVING RECORDING HEAD

CROSS REFERENCE TO RELATED APPLICATIONS

This is a division of co-pending application Ser. No. 09350,296, filed Jul. 9, 1999, which in turn is a division of application Ser. No. 08/300,122, filed Sep. 2, 1994 (now U.S. Pat. No. 5,943,070, issued Aug. 24, 1999).

BACKGROUND OF THE INVENTION

1. Field of the Invention

The present invention relates to a substrate for an ink jet recording head, a recording head using the substrate, a recording apparatus with the recording head, and a method of driving the recording head.

2. Related Background Art

Nowadays, various recording methods have been developed and are available. Of these methods, ink jet recording methods for performing recording by emitting an ink from emission ports in accordance with a recording signal are popularly used since the apparatus used in these methods can be easily rendered compact and generates low noise. Among these methods, a method using electro-thermal energy conversion elements for applying heat to an ink to cause a bubble forming phenomenon as emission energy generation elements for emitting an ink is preferably used.

An ink jet recording head of this type has an element substrate on which first resistor elements (ink emission resistor elements) as electro-thermal energy conversion elements, which are electrically connected to a function element for selectively driving a plurality of electro-thermal energy conversion elements for emitting an ink, as described above, and second resistor elements (temperature control resistor elements), which are arranged for adjusting the viscosity of the ink by controlling the temperature, and are not electrically connected to the function element, are formed.

When the resistance values of the first resistor elements formed on the element substrate suffer a variation in the manufacture, if a common driving If voltage is applied to the respective heads, different amounts of heat are generated due to a variation in resistance value, resulting in different ink bubble forming phenomena. Thus, ink emission amounts become nonuniform in units of heads, or stable ink emission cannot often be attained. Therefore, the resistance values of the emission resistor elements of the respective heads must be measured by some method, and voltages corresponding to the measured resistance values must be applied to suppress emission amount nonuniformity. However, when the resistance value of the emission resistor element of each head is to be directly measured, a resistance value including the resistance value of the emission resistor element and that of the function element electrically connected thereto is undesirably measured. As a result, the resistance value of only the emission resistor element cannot be accurately measured.

For this reason, the present inventors measured the resistance value of the temperature control resistor element which was electrically independent from the function element formed in a similar manner to that of the emission resistor element, and calculated a sheet resistance value based on the measured resistance value of the temperature control resistor element, thus estimating the resistance value of the emission resistor element.

On the basis of the estimated resistance value, data for setting an appropriate driving signal for stable emission of an ink is stored as, e.g., 4-bit data in a memory circuit on a printed circuit board on a recording head. When the recording head which stores data of the driving electric power is mounted on a recording apparatus, a control circuit unit of the ink jet recording apparatus reads data stored in the recording head, and supplies a driving signal suited for driving the emission resistor elements to the recording head in accordance with the read data, thus achieving adjustment of ink emission in units of heads.

However, the above-mentioned temperature control resistor element has a resistance value smaller than that of the emission resistor element since it has a resistor shape satisfying $L_1/W_1>L_2/W_2$, $W_1<W_2$, and $L_1<L_2$ ($W_1$ and $L_1$ are respectively the width and length of the emission resistor element, and $W_2$ and $L_2$ are respectively the width and length of the temperature control resistor element), so as not to form a bubble in an ink upon driving of the temperature control resistor element.

As described above, since the resistance value of the temperature control resistor element is set to be lower than that of the emission resistor element, when the resistance value is measured using the temperature control element, it is difficult to sufficiently accurately estimate the resistance value of the emission resistor element, and hence, it is difficult to drive the head by applying an appropriate driving signal to the emission resistor element.

On the other hand, when data for setting an appropriate driving signal condition for stable emission of an ink is stored in, e.g., the memory circuit on the printed circuit board on the basis of the resistance value estimated from the temperature control resistor, as described above, the number of data to be able to be stored is limited to several bits (e.g., 4 bits) in terms of a space for arranging the memory circuit. For this reason, the setting range of driving electric power to be applied to the emission resistor element is undesirably widened. In such a case, it is difficult to supply an appropriate driving signal to the emission resistor element. In order to solve this problem and to store a larger number of storage data, a memory element (e.g., a ROM or the like) may be mounted on the printed circuit board, or a region for arranging the memory circuit may be widened. However, this results in an increase in cost or size of the recording head itself.

When an appropriate driving signal cannot be set for the ink emission resistor element, e.g., when a driving signal is set to be too low, ink emission becomes unstable, and the dot size of an ink droplet diminishes, resulting in deterioration of print quality. On the other hand, when driving electric power is set to be too high, since electric power exceeding required power is supplied to the emission resistor element, the service life of the emission resistor element is shortened, and reliability of the recording head is lowered, thus posing problems to be solved.

SUMMARY OF THE INVENTION

The present invention has been made to solve the above-mentioned problems, and a representative means for solving the problems according to the present invention is a substrate for a thermal recording head, comprising a plurality of heating resistor elements for performing recording by generating heat, a plurality of wiring electrodes for supplying driving signals to the heating resistor elements, a function element, electrically connected to the heating resistor elements, for selectively driving the plurality of heating resistor elements, and a measurement resistor element which is electrically independent from the heating resistor elements and the function element, and has a resistance value larger than that of each heating resistor element, an ink jet recording head comprising emission ports for emitting an ink, ink channels for guiding the ink to positions near the emission ports, and a substrate provided with heating resistor elements used for emitting the ink from the emission ports by applying heat to the ink, a plurality of wiring electrodes for supplying driving signals to the heating resistor elements, a function element, electrically connected to the heating resistor elements, for selectively driving the plurality of resistor elements, and a measurement resistor element which is electrically independent from the heating resistor elements and the function element, and has a resistance value larger than that of each heating resistor element, an ink jet recording apparatus which can detachably mount an ink jet recording head comprising: a substrate provided with heating resistor elements for emitting an ink from emission ports by applying heat to the ink, a plurality of wiring electrodes for supplying driving signals to the heating resistor elements, a function element, electrically connected to the heating resistor elements, for selectively driving the plurality of resistor elements, and a measurement resistor element which is electrically independent from the heating resistor elements and the function element, and has a resistance value larger than that of each heating resistor element; emission ports for emitting an ink; and ink channels for guiding the ink to positions near emission ports, and which comprises a control circuit for electrically measuring a value based on the resistance value of the measurement resistor element of the mounted recording head, and setting a condition of a driving signal for driving the heating resistor elements on the basis of the measured resistance value, or a method of driving a recording head, comprising the step of electrically measuring a value based on a resistance value of a measurement resistor element arranged in a recording head for performing recording based on heat generated by heating resistor elements, the step of setting a driving signal to be applied to the heating resistor elements on the basis of the measured value, and the step of applying the set driving signal to the heating resistor elements of the recording head.

DETAILED DESCRIPTION OF THE PREFERRED EMBODIMENTS

The embodiment of the present invention will be described in detail below with reference to the accompanying drawings.

Figure 1:
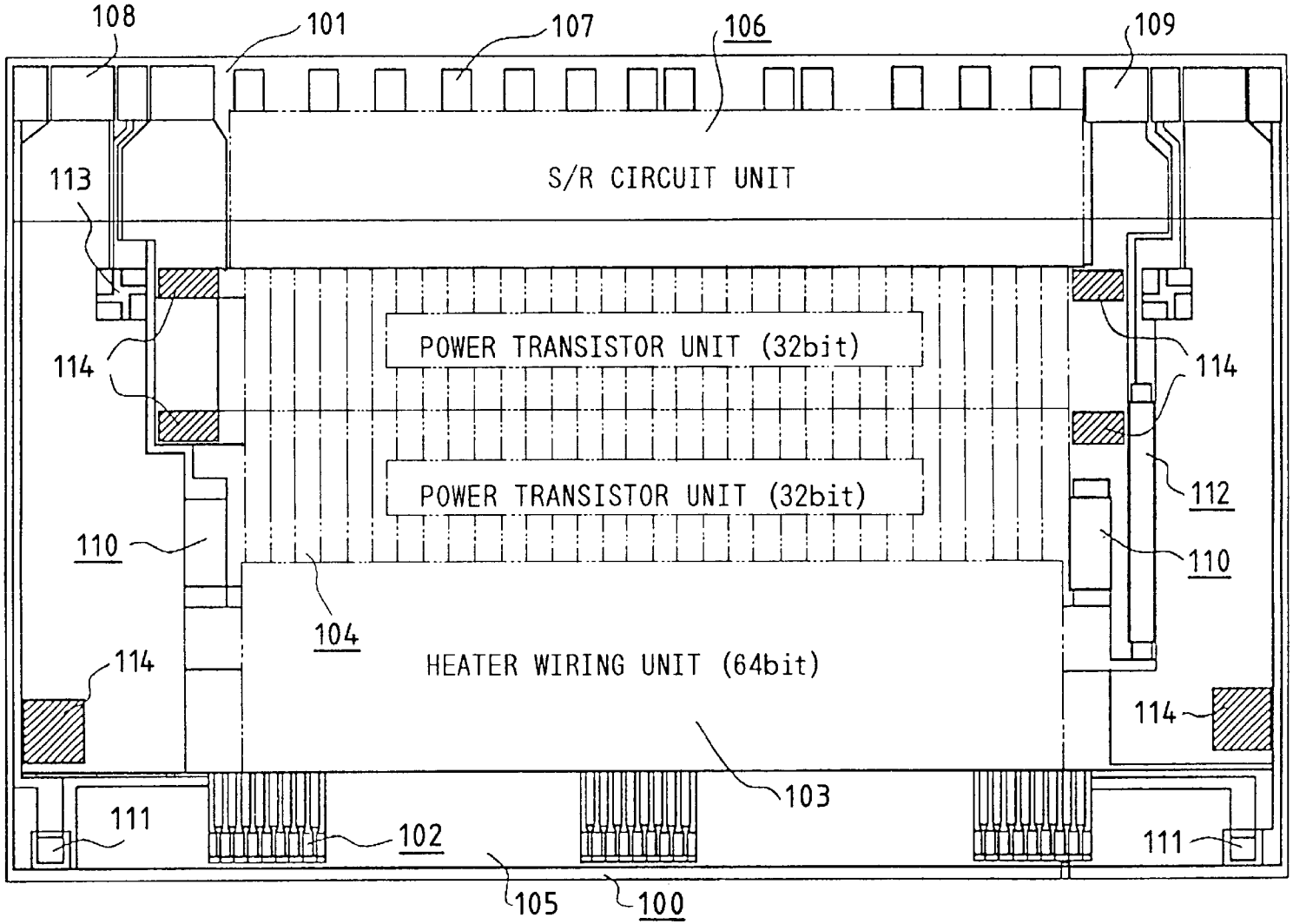
FIG. 1 is a plan view showing a substrate of a recording head to which the present invention is applied.

FIG. 1 shows a substrate 100 for an ink jet recording head according to an embodiment of the present invention. As shown in FIG. 1, first resistor elements 102 (to be also referred to as heating resistor elements hereinafter) each for generating heat energy which causes a boiling phenomenon in an ink and emits the ink from an emission port are formed on a substrate of a recording head in a film formation process in correspondence with a plurality of ink emission ports. Function elements such as drivers 104 electrically connected to the plurality of heating resistor elements 102, shift registers 106 for parallelly outputting image data which is serially input to the recording head, latch circuits for temporarily storing data output from the shift registers 106, and the like are formed in the film formation process on the single substrate on which the heating resistor elements are formed. Also, temperature control resistor elements 110 as second resistor elements and a measurement resistor element 112 as a third resistor element, which are formed in the same process as that for forming the heating resistor elements 102, are formed on the substrate 100.

Each of the second resistor element is a resistor element for heating the substrate 100 to keep a constant ink temperature (viscosity) so that stable emission is assured even when the environmental temperature of the recording head changes, as described above. The third resistor element 112 (to be also referred to as a measurement resistor element) is formed to have a shape $W_3 \times l_3$ (width×length) to satisfy relations $l_1/W_1 < l_3/W_3$ with respect to the shape $W_1 \times l_1$ of the heating resistor element, so as to have a resistance value larger than that of the heating resistor element (first resistor element) 102 whose resistance value is to be estimated. The resistance value of the measurement resistor element 112 is measured by a method to be described later, and the sheet resistance value of the measurement resistor element is calculated. The resistance value of the heating resistor element 102 can be estimated from the calculated sheet resistance value. In addition, as the measurement resistor element 112 has a larger resistance value, the resistance value of the measurement resistor element can be measured with higher accuracy, and as a result, the resistance of the heating resistor element can be estimated with higher precision.

When an exchangeable head having such a rank resistor element is mounted on a carriage of a printer, the resistance of the measurement (third) resistor element of a recording head 410 is read. In the reading method, a constant current is applied to the measurement resistor element, and the value of the measurement resistor element is converted from a voltage value measured at that time. For example, a constant current of 10 mA is applied to the measurement resistor element, and a voltage value of 1.2 V at that time is measured, thus determining the resistance of the measurement resistor element to be 120 Ω.

Since the first, second, and third resistor elements are formed in a single film formation process, heating resistor layers have substantially the same thicknesses in the substrate. At this time, when the elements are formed in patterns having $W_1$=20 μm, $l_1$=120 μm, $W_3$=100 μm, and $l_3$=1,300 μm, and the sheet resistance of a resistor layer is assumed to be 22.8 Ω/unit area, the resistance of the heating (first) resistor element is given by:

$$R_1=l_1/W_1\times 22.8=136.8\ \Omega$$

and, the resistance of the measurement (third) resistor element is given by:

$$R_3=l_3/W_3\times 22.8=296.4\ \Omega$$

When the resistance value is read by the above-mentioned resistance measurement method, the voltage value of the first resistor element is 1.37 V, and that of the third resistor element is 2.96 V, thus improving reading accuracy by a factor of about 2.2 times.

As described above, when the resistance value of the measurement resistor element is set to be larger than that of the heating resistor element, the resistance value of the heating resistor element can be satisfactorily measured, and a signal to be supplied to the heating resistor element can be satisfactorily set. In this embodiment, the resistance value of the measurement resistor element is set to be about 2.2 times that of the heating resistor element, but need only be set to be at least 1.5 times that of the heating resistor element. However, it is preferably set to be at least twice that of the heating resistor element to obtain sufficiently high accuracy.

Figure 2:
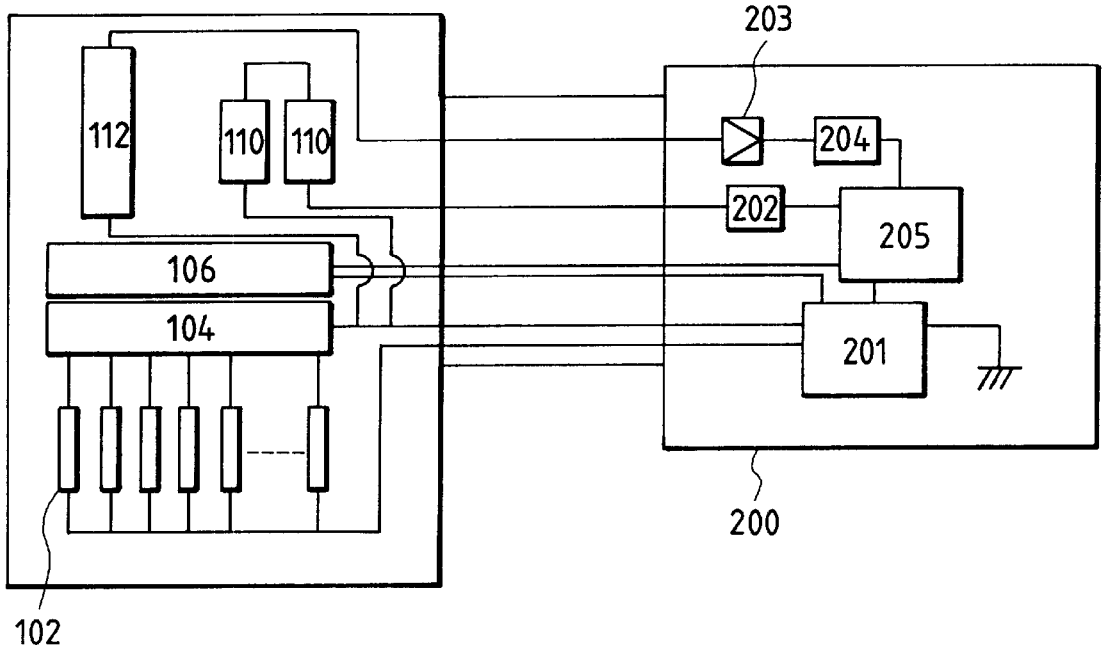
FIG. 2 is a block diagram showing the arrangement for driving heaters.

FIG. 2 is a block diagram showing the arrangement for supplying a driving signal to the substrate 100 shown in FIG. 1. In FIG. 2, a logic circuit 205 supplies a constant current from a power supply 201 for supplying electric power (signal) required for driving to the measurement resistor element 112, amplifies an output voltage from the resistor element by an amplifier 203, A/D-converts the amplified signal by an A/D converter 204, and supplies driving pulses, which are set in correspondence with the resistance value signal of the measurement resistor element, to the heating resistor elements 102.

Figure 3:
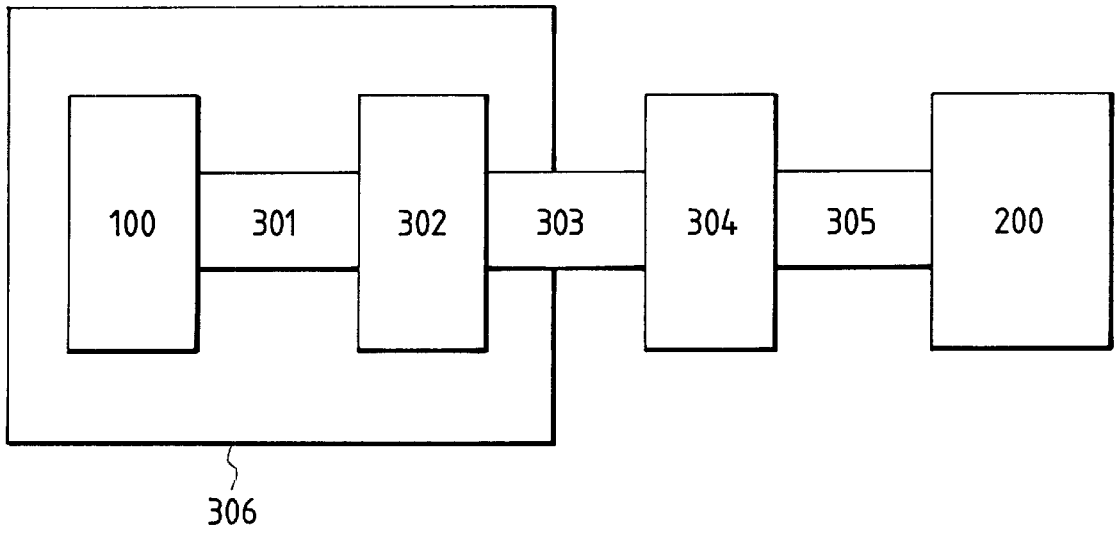
FIG. 3 is a block diagram showing the electrical connection between a recording head and a recording apparatus.

FIG. 3 is a block diagram illustrating the electrical connection state obtained when the recording head is mounted on an ink jet recording apparatus main body.

As shown in FIG. 3, the recording head is connected to an electrical mount circuit board 200 of the apparatus main body via a flexible cable 304. At this time, the flexible cable 304 and the electrical mount circuit board 200 are connected to each other via a connector 305, the recording head and the flexible cable are connected by a press contact 303, and the substrate 100 and a printed wiring circuit board 302 are connected to each other by wire bonding 301.

Figure 4:
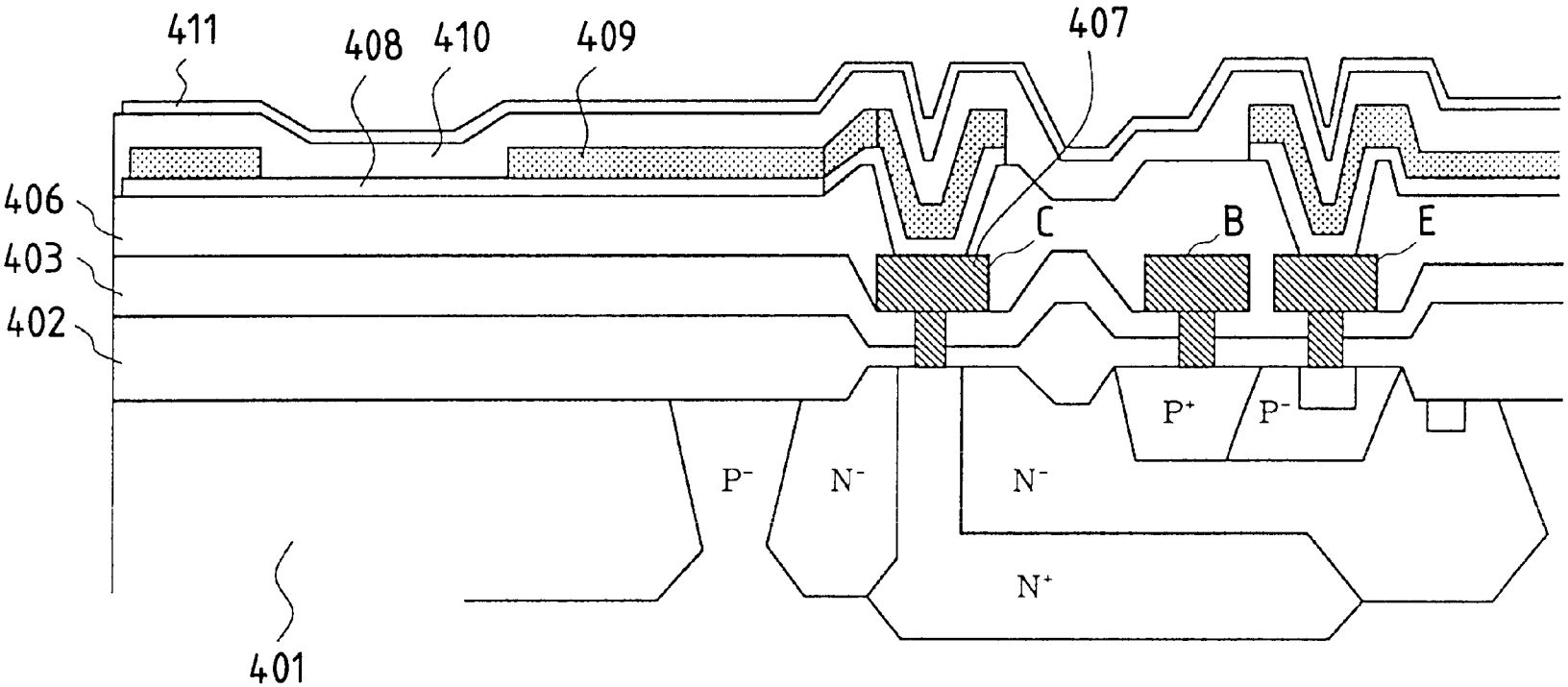
FIG. 4 is a sectional view of a recording head substrate.

FIG. 4 is a sectional view of the substrate in which the heating resistor elements are formed on a common substrate in a film formation manufacturing process.

The steps in the manufacture of the substrate will be described below with reference to FIGS. 4 and 5A to 5E.

Figure 5A:
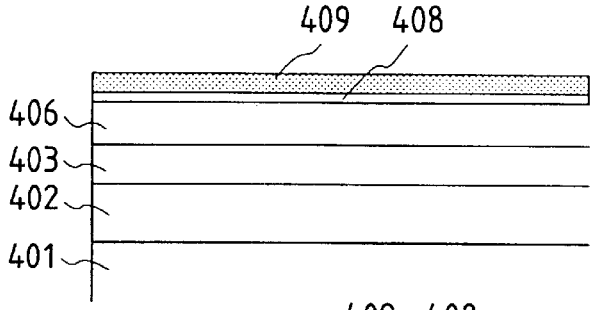
FIGS. 5A to 5E are sectional views for explaining the steps in the manufacture of a substrate according to the present invention.
Figure 5B:
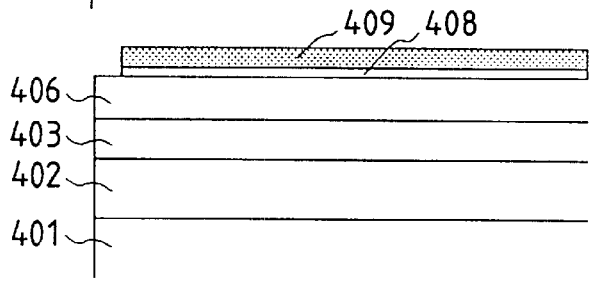
Figure 5C:
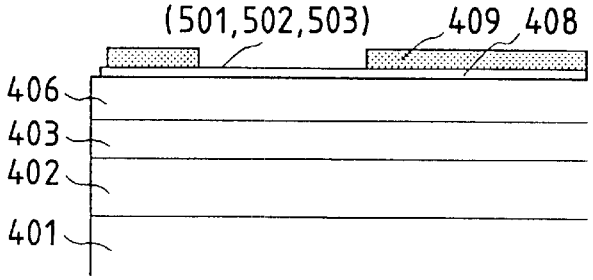
Figure 6:
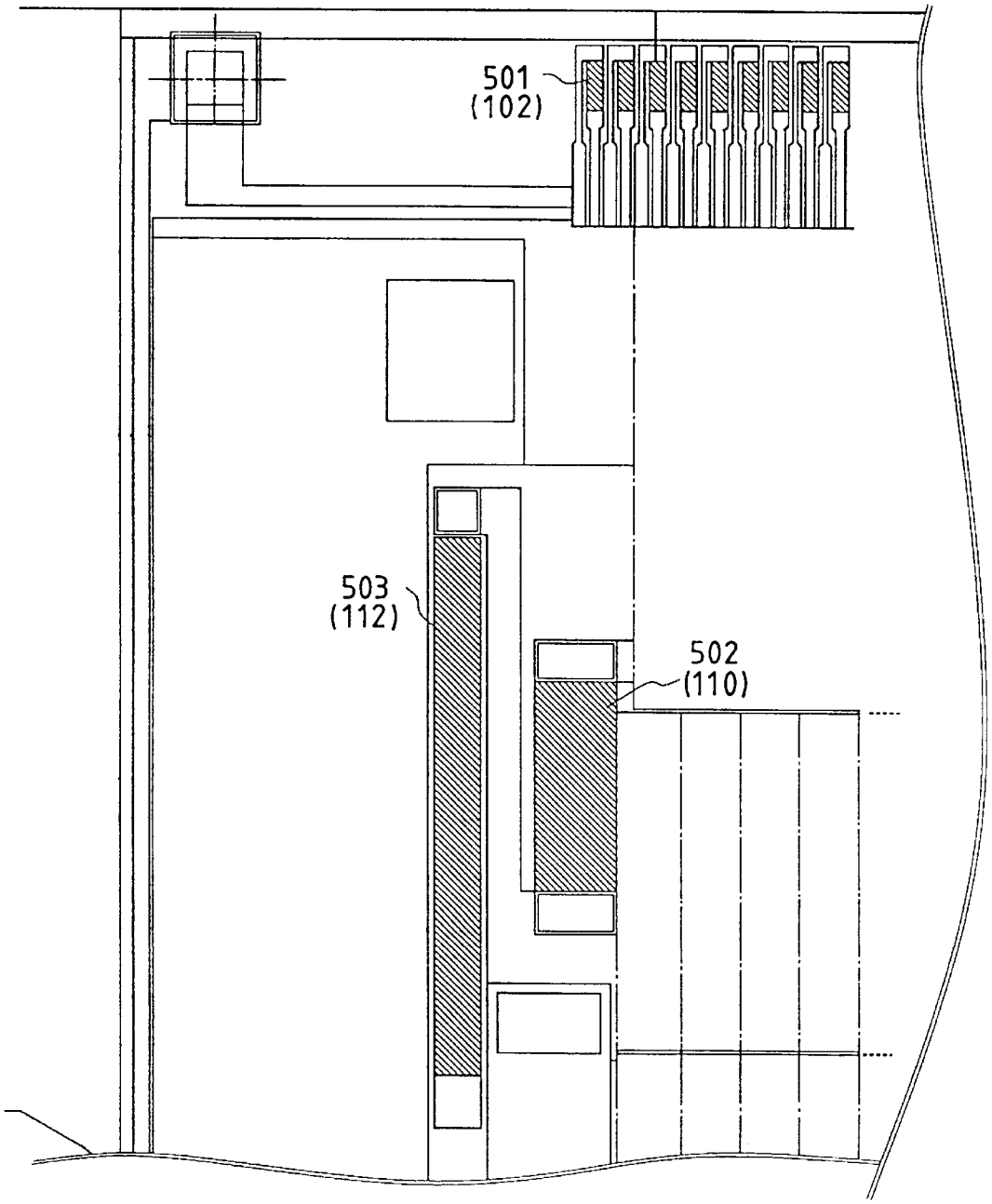
FIG. 6 is a partial plan view of the substrate according to the present invention.

As shown in FIG. 4, function elements (shift registers, power transistors, and the like) are formed on an SOI substrate by p- and n-type doped regions. A single crystalline layer in a region other than the function element formation regions is thermally oxidized by a LOCOS method to simultaneously form an accumulation layer and an element isolation layer under heaters 402. A PSG film layer 403 is formed by a CVD method, a through hole is formed in the PSG film layer using the photolithography technique, and a first Al electrode film 407 is formed thereon by a sputtering method. The Al electrode film is patterned using a photolithography technique. A 1.4-$\mu$m thick $SiO_2$ (silicon oxide) film is formed as an insulating interlayer 406 on the PSG film layer by a plasma CVD method, a through hole is formed in the insulating interlayer using a photolithography technique, and a TaN film is formed thereon as a resistor layer 408 by a sputtering method. Then, a second electrode layer 409 is formed on the TaN layer by a sputtering method (FIG. 5A). In order to form first resistor elements 501, second resistor elements 502, and a third resistor element 503 of a heat acting portion in a pattern shown in FIG. 6 using a photolithography technique, the second electrode Al layer 409, a tantalum nitride layer (TaN 408) as a resistor layer, and a hafnium boride (HfB) layer are simultaneously dry-etched (FIG. 5B), and the second electrode Al layer 409 is wet-etched (FIG. 5C), thereby forming heating resistor elements 501, 502, 503.

Figure 5D:
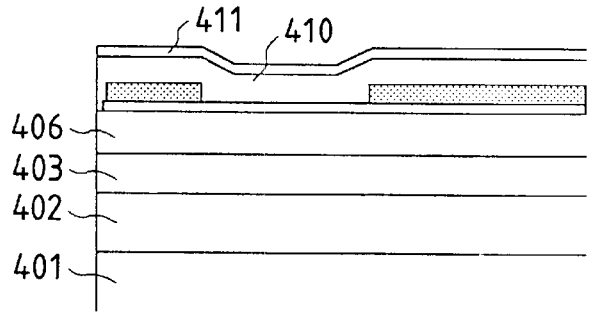
Figure 5E:
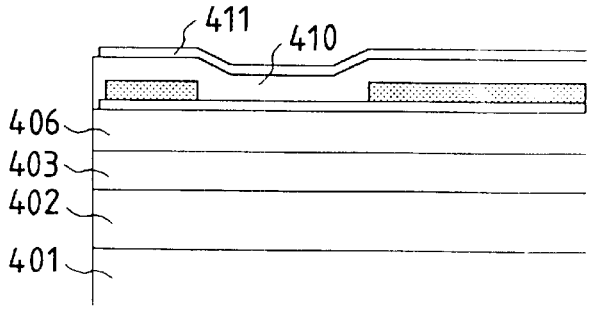

An SiN layer is formed as a protective film layer by a plasma CVD method, and a Tc layer as a second protective layer is formed thereon by a sputtering method (FIG. 5D). The Tc layer is pattered by a photolithography technique, and a through hole is formed in the SiN layer to open an electrode extraction portion (FIG. 5E).

A method of supplying an appropriate driving signal to the head using the measurement resistor element will be described below.

When an exchangeable head is mounted on a carriage of a printer main body, the logic circuit 205 of the printer main body electrically reads the resistance value of the measurement resistor element 112 of the recording head by measuring a voltage, current value, or the like. The logic circuit estimates the resistance value of the heating resistor element 102 on the basis of the resistance value of the measurement resistor element 112, and sets a pulse width required for obtaining a constant driving signal (electric power) to be applied to the emission resistor elements 102 by utilizing a method of determining a driving signal required for stable emission of an ink with respect to the resistance value of the measurement resistor element even when the resistance value of the measurement resistor element 112 falls within a tolerance range. Then, the logic circuit applies a driving signal required for stable emission with respect to the resistance value of the measurement resistor element 112, which value is read by the above-mentioned method, to the heaters 102 in accordance with image data.

In the description of the above embodiment, the measurement resistor element is arranged in addition to the heating resistor elements and the temperature control resistor elements, and the resistance value of the measurement resistor element is read by the apparatus side. However, in a head which allows the temperature control resistor elements to form bubbles in an ink, or in a head which supplies a driving signal to the temperature control resistor element so as not to form bubbles in an ink, the resistance value of the temperature control resistor element may be set to be larger than that of the heating resistor element, and may also serve as a measurement resistor element.

In this case, the apparatus must have a switch for switching between a temperature control element driving circuit and a measurement circuit, and cost increases slightly. For this reason, it is preferable to independently arrange a measurement resistor element as in the above embodiment.

Figure 7:
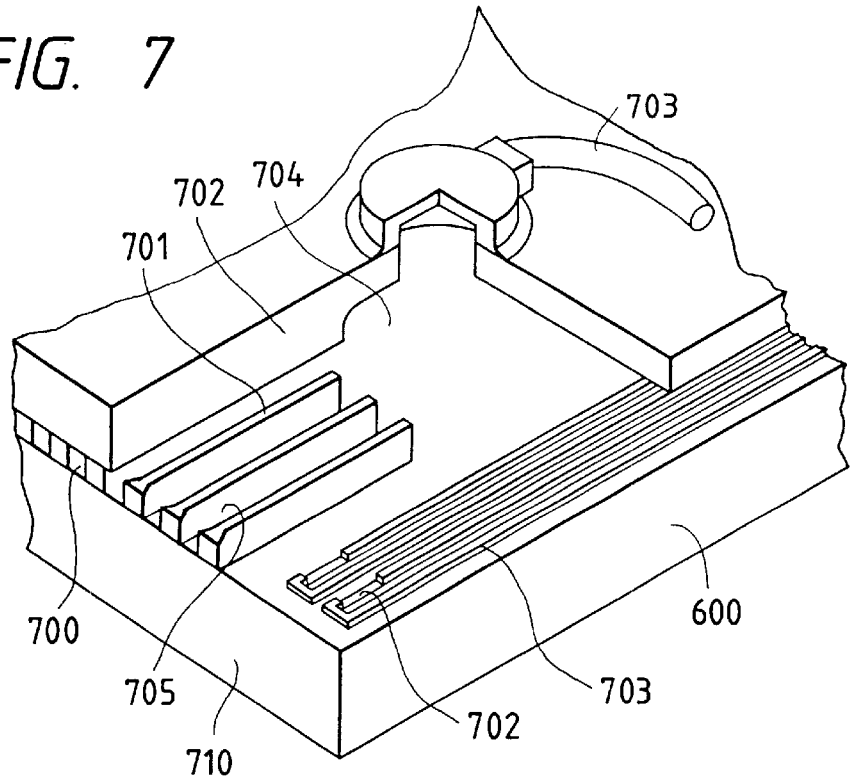
FIG. 7 is a partially cutaway perspective view showing a recording head according to the present invention.

FIG. 7 shows an ink jet recording head 710 in which ink channel wall members 701 are formed on a substrate 600 of the present invention to form ink channels 705 and emission ports 700. On the substrate, a heating unit 702 including the heating resistor elements, wiring lines 703 connected to the heating resistor elements, and other elements of the present invention described above with reference to FIG. 1 are formed.

An ink supplied from an ink supply port of the recording head is guided to a common ink chamber 704 for supplying an ink to a plurality of ink channels, and is supplied from the common ink chamber to the ink channels. When driving signals are supplied to the heating resistor elements arranged in correspondence with the ink channels via the wiring lines 703, the heating resistor elements generate heat to be applied to the ink. With this heat, the ink forms a bubble, and an ink droplet is emitted from each emission port 700 by a pressure upon formation of the bubble.

Figure 8:
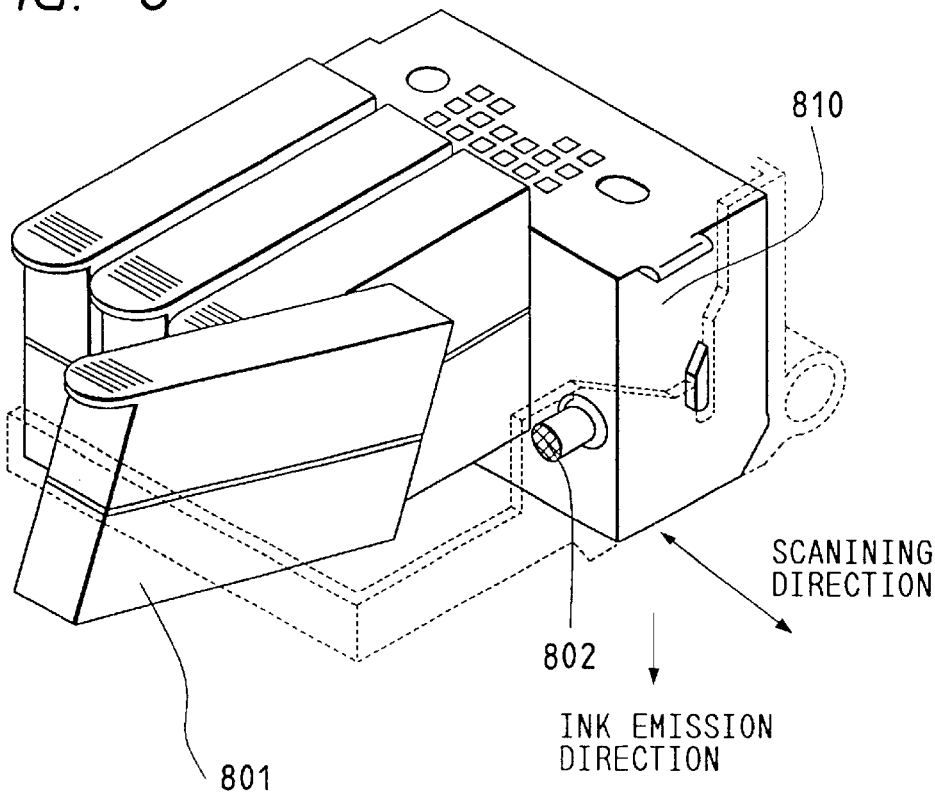
FIG. 8 is a perspective view for explaining a recording head cartridge according to the present invention.

FIG. 8 is a view for explaining a recording head cartridge according to the present invention.

Ink tanks 801 are connected, via ink supply portions 802, to a recording head unit 810 on which four recording heads each having the above-mentioned arrangement shown in FIG. 7 and corresponding to four colors, i.e., yellow, magenta, cyan, and black, are integrally arranged.

When the recording head or head cartridge with the above-mentioned arrangement is detachably mounted on a recording apparatus main body, and a signal is supplied from the apparatus main body to the recording head or heads 710, an ink jet recording apparatus which can realize high-speed recording and high-image quality recording can be obtained.

Figure 9:
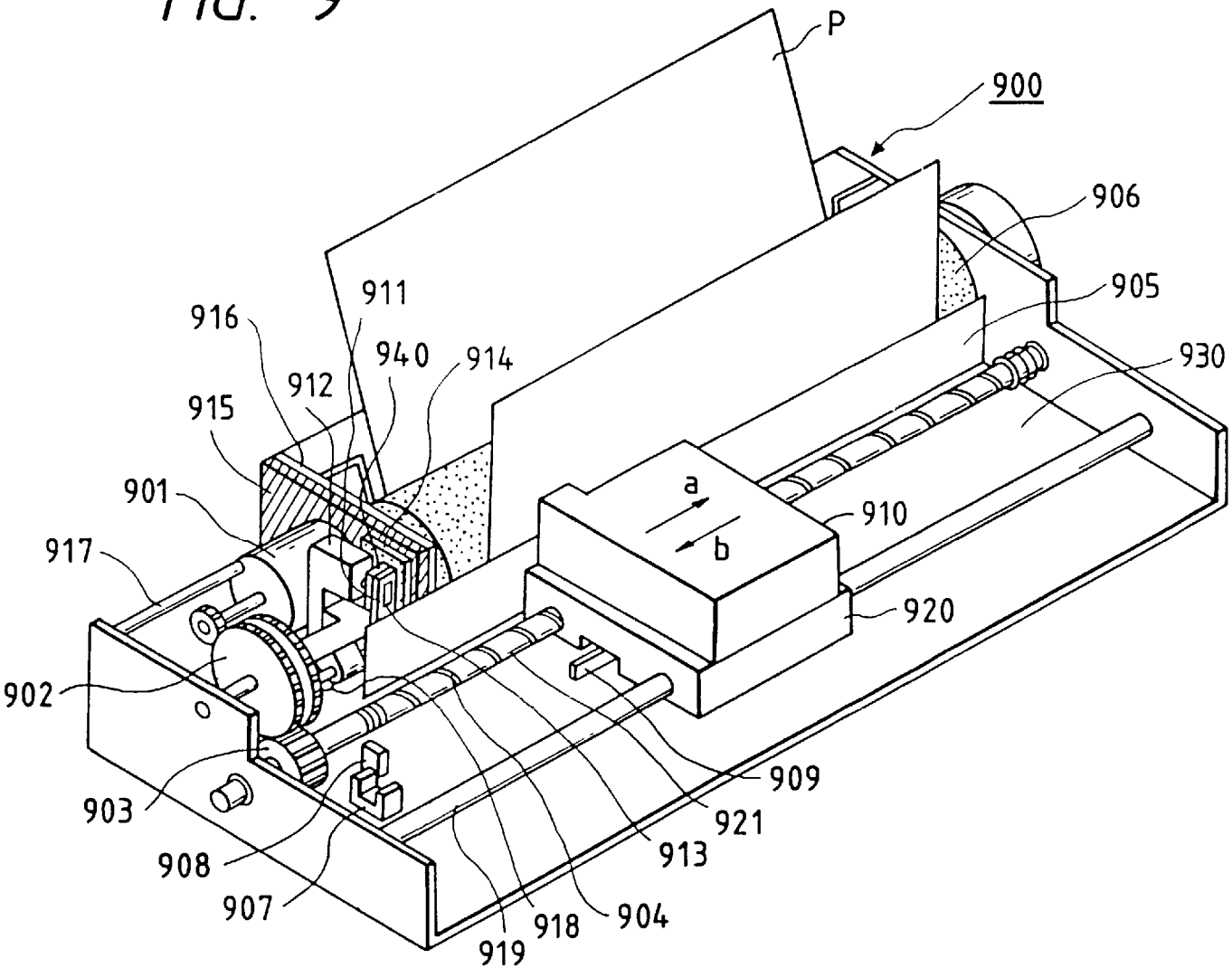
FIG. 9 is a perspective view showing a recording apparatus according to the present invention.

An ink jet recording apparatus using a recording head of the present invention will be described below with reference to FIG. 9. FIG. 9 is a schematic perspective view showing an example of an ink jet recording apparatus 900 to which the present invention is applied.

A recording head cartridge 910 is mounted on a carriage 920, which is engaged with a spiral groove 921 of a lead screw 904 rotated via driving force transmission gears 902 and 903 in synchronism with the forward/reverse rotation of a driving motor 901. The recording head cartridge 910 is reciprocally moved in the directions of arrows a and b along a guide 919 together with the carriage 920 by the driving force generated by the driving motor 901. A paper pressing plate 905 for a recording paper sheet P, which is fed onto a platen 906 by a recording medium feeding device (not shown), presses the recording paper sheet P against the platen 906 across the carriage moving direction.

Photocouplers 907 and 908 serve as home position detection means for confirming the presence of a lever 909 of the carriage 920 in a corresponding region, and performing switching of the rotational direction of the driving motor 901, and the like. A support member 940 supports a cap member 911 for capping the entire surface of the above-mentioned recording heads 910. A suction means 912 sucks the interior of the cap member 911, and performs a suction recovery operation of the recording heads 910 via an intra-cap opening 913. A cleaning blade 914 is supported by a movable member 915 to be movable in the back-and-forth direction, and these members are supported on a main body support plate 916. Note that cleaning blade 914 need not have a shape shown in FIG. 9, but a known cleaning blade can be applied to this embodiment. A lever 917 is used for initiating a suction operation of the suction recovery operation, and is moved upon movement of a cam 918 which is engaged with the carriage 920. The movement of the lever 917 is controlled by known transmission CD means such as clutch switching on the basis of the driving force from the driving motor 901. A print control unit for supplying a signal to heating resistor elements provided to the recording heads 910 and performing driving control of the above-mentioned mechanisms is arranged on the apparatus main body side (not shown).

The ink jet recording apparatus 900 with the above arrangement performs recording while reciprocally moving the recording heads 910 across the total width of the recording paper sheet P which is fed onto the platen 906 by the recording medium feeding device, and the recording heads 910 are manufactured by the above-mentioned method, thus allowing high-accuracy, high-speed recording.

In the above description, the substrate is applied to an ink jet recording head. However, the substrate according to the present invention can be applied to, e.g., one for a thermal head.

The present invention brings about excellent effects particularly in a recording head and a recording apparatus adopting a system, proposed by CANON INC., for emitting an ink using heat energy, among ink jet recording systems.

As the representative arrangement and principle of the ink jet recording system, one practiced by use of the basic principle disclosed in, for example, U.S. Pat. Nos. 4,723,129 and 4,740,796 is preferred. The above system is applicable to either one of so-called an on-demand type and a continuous type. Particularly, in the case of the on-demand type, the system is effective because, by applying at least one driving signal, which corresponds to recording information and gives a rapid temperature rise exceeding nucleus boiling, to each of electro-thermal energy conversion elements arranged in correspondence with a sheet or liquid channels holding liquid (ink), heat energy is generated by the electro-thermal conversion element to effect film boiling on the heat acting surface of the recording head, and consequently, a bubble can be formed in the liquid (ink) in one-to-one correspondence with the driving signal. By emitting the liquid (ink) through an emission port by growth and shrinkage of the bubble, at least one droplet is formed. If the driving signal is applied as a pulse signal, the growth and shrinkage of the bubble can be attained instantly and adequately to achieve emission of the liquid (ink) with the particularly high response characteristics. As the pulse driving signal, signals disclosed in U.S. Pat. Nos. 4,463,359 and 4,345,262 are suitable. Note that further excellent recording can be performed by using the conditions described in U.S. Pat. No. 4,313,124 of the invention which relates to the temperature rise rate of the heat acting surface.

As an arrangement of the recording head, in addition to the arrangement as a combination of emission ports, liquid channels, and electro-thermal energy conversion elements (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open Application No. 59-123670 which discloses the arrangement using a common slit as an emission portion of electro-thermal energy conversion elements, or Japanese Patent Laid-Open Application No. 59-138461 which discloses the arrangement having an opening for absorbing a pressure wave of heat energy in correspondence with an emission portion.

Furthermore, as a full line type recording head having a length corresponding to the width of a maximum recording medium which can be recorded by the recording apparatus, either the arrangement which satisfies the full-line length by combining a plurality of recording heads as disclosed in the above specification or the arrangement as a single recording head obtained by forming recording heads integrally can be used. With such a recording head, the present invention can exhibit the above-mentioned effect more effectively.

In addition, the present invention is effective for a case using an exchangeable chip type recording head which can be electrically connected to the apparatus main body or can receive an ink from the apparatus main body upon being mounted on the apparatus main body, or a cartridge type recording head provided integrally with the recording head itself.

It is preferable to add recovery means for the recording head, preliminary auxiliary means, and the like provided as an arrangement of the recording apparatus of the present invention since the effect of the present invention can be further stabilized. Examples of such means include, for the recording head, capping means, cleaning means, pressurization or suction means, and preliminary heating means using electro-thermal energy conversion elements, another heating element, or a combination thereof. It is also effective for stable recording to execute a preliminary emission mode which performs emission independently of recording.

Furthermore, as a recording mode of the recording apparatus, the present invention is extremely effective for not only an apparatus having a recording mode using only a primary color such as black or the like, but also an apparatus having at least one of a multi-color mode using a plurality of different colors or a full-color mode achieved by color mixing, although such modes may be attained either by using an integrated recording head or by combining a plurality of recording heads.

Moreover, in the embodiment of the present invention, an ink is described as a liquid. Alternatively, the present invention may employ an ink which is solidified at room temperature or less, and is softened or liquefied at room temperature, or an ink, which is liquefied upon application of a use recording signal since it is a general practice to perform temperature control of the ink itself within a range between 30° C. and 70° C. in the above-mentioned ink jet system so that the ink viscosity can fall within a stable ejection range. In addition, a temperature rise caused by heat energy may be prevented by positively utilizing the temperature rise as energy for a change in state from a solid state to a liquid state of the ink, or an ink which is solidified in a non-use state for the purpose of preventing evaporation of the ink may be used. In any case, the present invention can be applied to a case wherein an ink, which can be liquefied by heat energy such as an ink which is liquefied upon application of heat energy according to a recording signal, and is ejected in a liquid state, an ink which begins to be solidified when it reaches a recording medium, or the like may be used. In this case, an ink may be held in a liquid or solid state in recess portions or through holes of a porous sheet, as described in Japanese Laid-Open Patent Application No. 54-56847 or 60-71260, and the porous sheet may be arranged to oppose electrothermal converting elements. In the present invention, a system which executes the above-mentioned film boiling method is most effective for the above-mentioned inks.

A recording head device and its driving method according to the present invention can also be preferably used in a case wherein recording (including printing) is performed on cloth, yarn, and the like, and can be particularly suitably applied to a printing system added with an apparatus for performing pre- and post-processes for cloth, yarn, and the like.

As described above, the substrate of the present invention has the measurement resistor element which is electrically independent from the heating resistor elements and function elements, and has a resistance value larger than that of the heating resistor element. For this reason, the resistance value can be measured without being influenced by the function elements, and measurement of the resistance value can be realized with higher accuracy.

With this structure, since an appropriate driving voltage can be applied to the heating resistor elements, the service life of the heating resistor elements themselves can be remarkably prolonged.

Since the recording head and ink jet head cartridge according to the present invention uses the above-mentioned substrate, they can receive an electrical signal which is set based on the accurately measured resistance value. For this reason, formation of bubbles in units of heads can be stabilized, and a variation in ink emission and an emission error can be prevented. Even when the resistance value of the heating resistor element slightly varies due to a difference in the manufacturing process, the head can receive a driving signal corresponding to the resistance value. For this reason, a recording head which can improve the manufacturing yield can be provided. Furthermore, since no memory circuit need be formed on a circuit board of the recording head, a low-cost, compact recording head can be provided.

In the recording apparatus of the present invention, even when heads have heating resistor elements with different resistance values upon exchange of heads, the resistance value can be accurately read from the measurement resistor element of each of mounted recording heads, and an appropriate driving signal can be applied to the heating resistor elements of the corresponding recording head on the basis of the measured resistance value. For this reason, even when a recording head is exchanged or when a plurality of recording heads are mounted, satisfactory recording can be realized. In the method of driving the recording head according to the present invention, data based on the measured resistance value need not be stored on a printed circuit board, and the resistance value of the measurement resistor element in the head is directly electrically read. For this reason, a compact head can be realized, and a driving signal which can finely cope with a variation in resistance value of the heating resistor element can be set more easily than a conventional method of setting a driving signal.

What is claimed is:

1. An ink jet recording head for performing recording by emitting an ink from an opening by utilizing heat, comprising:

a plurality of heating resistor elements for generating heat to emit an ink from said opening, each said heating resistor element having a width $W_1$, a length $l_1$, and a thickness $t_1$;

a plurality of wiring electrodes electrically connected for supplying driving signals to said heating resistor elements; and a measurement resistor element which is electrically independent from said heating resistor elements and is arranged so that a resistance value of said measurement resistor element can be measured, said measurement resistor element having a width $W_3$, a length $l_3$, and a thickness $t_3$, wherein $l_1/W_1<l_3/W_3$ is satisfied and said thickness $t_1$ is substantially the same as said thickness $t_3$.

2. An ink jet recording head according to claim 1, further including a temperature control resistor element which is electrically independent from said heating resistor elements and said measurement resistor element, and which is utilized for applying heat to ink in said recording head.

3. A recording head according to claim 2, wherein said heating resistor elements and said measurement resistor element are formed from a resistor layer manufactured in a single process.

4. A recording head according to claim 3, wherein said resistor elements consist of a tantalum nitride or hafnium boride film.

5. A recording head according to claim 1 and further including:

emission ports for emitting an ink;

ink channels for guiding the ink to positions near said emission ports; and a substrate provided with said plurality of heating resistor elements used for emitting the ink from said emission ports by applying heat to the ink.

6. A recording head according to claim 5, wherein said heating resistor elements and said measurement resistor element are formed by a resistor layer manufactured in a single process.

7. A recording head according to claim 6, wherein said resistor elements consist of a tantalum nitride or hafnium boride film.

8. A recording head according to claim 6, wherein said measurement resistor element also serves as a temperature control resistor element, which is independent from said heating resistor elements and is utilized for applying heat to said substrate.

9. An ink jet recording head according to claim 5 and further including an ink tank mounted to supply ink to said ink channels.

10. An ink jet recording head according to claim 9, wherein said ink tank is detachably mounted.

11. An ink jet recording apparatus comprising an ink jet recording head for performing recording by emitting an ink by utilizing heat, a member for mounting said ink jet recording head, wherein said ink jet recording head comprises:

a plurality of heating resistor elements for generating heat to emit an ink from an opening, each said heating resistor element having a width $W_1$, a length $l_1$, and a thickness $t_1$;

a plurality of wiring electrodes electrically connected for supplying driving signals to said heating resistor elements; and a measurement resistor element which is electrically independent from said heating resistor elements and is arranged so that a resistance value of said measurement resistor element can be measured, said measurement resistor element having a width $W_3$, a length $l_3$ and a thickness $t_3$, wherein $l_1/W_1 < l_3/W_3$ is satisfied and said thickness $t_1$ is substantially the same as said thickness $t_3$.

12. An ink jet recording apparatus according to claim 11, further including a temperature control resistor element which is electrically independent from said heating resistor elements and said measurement resistor element, and which is utilized for applying heat to ink in said recording head.

13. An ink jet recording apparatus according to claim 12, wherein said heating resistor elements and said measurement resistor element are formed from a resistor layer manufactured in a single process.

14. An ink jet recording apparatus according to claim 13, wherein said resistor elements consist of a tantalum nitride or hafnium boride film.

15. An ink jet recording apparatus according to claim 11, and further including:

emission ports for emitting an ink;

ink channels for guiding the ink to positions near said emission ports; and a substrate provided with a plurality of heating resistor elements used for emitting the ink from said emission ports by applying heat to the ink.

16. An jet recording apparatus according to claim 15, wherein said heating resistor elements and said measurement resistor element are formed by a resistor layer manufactured in a single process.

17. An ink jet recording apparatus according to claim 16, wherein said resistor elements consist of a tantalum nitride or hafnium boride film.

18. An ink jet recording apparatus according to claim 16, wherein said measurement resistor element also serves as a temperature control resistor element, which is independent from said heating resistor elements and is utilized for applying heat to said substrate.

19. An ink jet recording apparatus according to claim 15 and further including an ink tank mounted to supply ink to said ink channels.

20. An ink jet recording apparatus according to claim 19, wherein said ink tank is detachably mounted.

21. A substrate for an ink jet recording head for performing recording by emitting an ink from an opening by utilizing heat, comprising:

a plurality of heating resistor elements for generating heat;

a plurality of wiring electrodes electrically connected for supplying driving signals to said heating resistor elements; and a measurement resistor element which is electrically independent from said heating resistor elements and is arranged so that a resistance value of said measurement resistor element can be measured, and having a resistance value larger than a resistance value of each of said heating resistor elements, wherein said heating resistor elements and said measurement resistor element are manufactured in a common process.

22. A substrate according to claim 21, further including a temperature control resistor element which is electrically independent from said heating resistor elements and said measurement resistor element, and which is utilized for applying heat to ink in said recording head.

23. A substrate according to claim 22, wherein said heating resistor elements and said measurement resistor element are formed from a resistor layer manufactured in a single process.

24. A substrate according to claim 23, wherein said resistor elements consist of a tantalum nitride or hafnium boride film.

25. A substrate according to claim 21, in combination with:

emission ports for emitting an ink; and ink channels for guiding the ink to positions near said emission ports;

said substrate provided with said plurality of heating resistor elements used for emitting the ink from said emission ports by applying heat to the ink.

26. A substrate according to claim 25, wherein said heating resistor elements and said measurement resistor element are formed by a resistor layer manufactured in a single process.

27. A substrate according to claim 26, wherein said resistor elements consist of a tantalum nitride or hafnium boride film.

28. A substrate according to claim 26, wherein said measurement resistor element also serves as a temperature control resistor element, which is independent from said heating resistor elements and is utilized for applying heat to said substrate.

29. A substrate according to claim 25, in combination with an ink tank mounted to supply ink to said ink channels.

30. A substrate according to claim 29, wherein said ink tank is detachably mounted.

31. An ink recording apparatus for performing recording by emitting an ink from an opening by utilizing heat, comprising:

a plurality of heating resistor elements for generating heat to emit an ink from said opening;

a plurality of wiring electrodes electrically connected for supplying driving signals to said heating resistor elements; and a measurement resistor element which is electrically independent from said heating resistor elements and is arranged so that a resistance value of said measurement resistor element can be measured, and having a resistance value larger than a resistance value of each of said heating resistor elements, wherein said heating resistor elements and said measurement resistor element are manufactured in a common process.

32. An ink jet recording apparatus according to claim 31, further including a temperature control resistor element which is electrically independent from said heating resistor elements and said measurement resistor element, and which is utilized for applying heat to ink in said recording head.

33. An ink jet recording apparatus to claim 32, wherein said heating resistor elements and said measurement resistor element are formed from a resistor layer manufactured in a single process.

34. An ink jet recording apparatus according to claim 33, wherein said resistor elements consist of a tantalum nitride or hafnium boride film.

35. An ink jet recording apparatus according to claim 31, and further including:

emission ports for emitting an ink; and ink channels for guiding the ink to positions near said emission ports;

a substrate provided with a plurality of heating resistor elements used for emitting the ink from said emission ports by applying heat to the ink.

36. An jet recording apparatus according to claim 35, wherein said heating resistor elements and said measurement resistor element are formed by a resistor layer manufactured in a single process.

37. An ink jet recording apparatus according to claim 36, wherein said resistor elements consist of a tantalum nitride or hafnium boride film.

38. An ink jet recording apparatus according to claim 36, wherein said measurement resistor element also serves as a temperature control resistor element, which is independent from said heating resistor elements and is utilized for applying heat to said substrate.

39. An ink jet recording apparatus according to claim 35 and further including an ink tank mounted to supply ink to said ink channels.

40. An ink jet recording apparatus according to claim 39, wherein said ink tank is detachably mounted.

* * * * *

UNITED STATES PATENT AND TRADEMARK OFFICE

CERTIFICATE OF CORRECTION

PATENT NO. : 6,471,339 B1 
DATED : October 29, 2002
INVENTOR(S) : Yuji Kamiyama et al.

It is certified that error appears in the above-identified patent and that said Letters Patent is hereby corrected as shown below:

Title page,
Item [56], FOREIGN PATENT DOCUMENTS, "3208654" should read -- 3-208654 --.
Item [57], ABSTRACT,
Line 12, "form" should read -- from --;
Line 13, "haws" should read -- has --.

Column 1,
Line 10, "09350,296," should read -- 09/350,296, --;
Line 45, "If" should be deleted.

Column 6,
Line 13, "pattered" should read -- patterned --.

Column 8,
Line 12, "so-called an" should read -- a so-called --.

Column 10,
Line 53, "including" should read -- including: --;
Lines 59, 63 and 66, "recording" should read -- ink jet recording --.

Column 11,
Lines 7, 11 and 14, "recording" should read -- ink jet recording --;
Line 45, "including" should read -- including: --.

Column 13,
Line 3, "ink" should read -- ink jet --.

Column 14,
Line 12, "jet" should read -- ink jet --.

Signed and Sealed this

Twelfth Day of August, 2003

JAMES E. ROGAN
*Director of the United States Patent and Trademark Office*